United States Patent [19]

Nyman

[11] Patent Number: 4,960,251

[45] Date of Patent: Oct. 2, 1990

[54] DETERMINING A REFERENCE IN A METHOD OF DETECTING OVERHEATING OF BEARINGS

[75] Inventor: Sigurd Nyman, Akersberga, Sweden

[73] Assignee: Frontec Produkter Aktiebolag, Sollentuna, Sweden

[21] Appl. No.: 383,904

[22] Filed: Jul. 21, 1989

Related U.S. Application Data

[63] Continuation-in-part of Ser. No. 142,735, Jan. 11, 1988, abandoned.

[30] Foreign Application Priority Data

Jan. 16, 1987 [SE] Sweden ..... 8700164

[51] Int. Cl.[5] ..... B61L 3/00

[52] U.S. Cl. ..... 246/169 A; 340/682

[58] Field of Search ..... 364/557; 340/682; 246/169 D, 169 A; 374/129, 57

[56] References Cited

U.S. PATENT DOCUMENTS

| | | | |
|---|---|---|---|
| 3,412,389 | 11/1968 | Barrack et al. | 246/169 D |
| 4,113,211 | 9/1978 | Glazar | 246/169 A |
| 4,316,175 | 2/1982 | Körber et al. | 374/57 |
| 4,441,196 | 4/1984 | Sanville | 246/169 A |

*Primary Examiner*—Parshotam S. Lall
*Assistant Examiner*—S. A. Melnick

[57] ABSTRACT

Auto-correlation techniques are employed to monitor railway care wheel bearings. Three successive bearing temperatures A, B and C are measured and those two temperatures that are the closest in value determined. The least of these is used as a reference to be multiplied by a constant and thereby define a limit value which when exceeded generates an alarm signal.

3 Claims, 3 Drawing Sheets

DETERMINING A REFERENCE IN A METHOD OF DETECTING OVERHEATING OF BEARINGS

CROSS REFERENCE TO RELATED APPLICATION

This application is a continuation-in-part of application Ser. No. 142,735, filed Jan. 11, 1988 and based upon a Swedish application filed Jan. 16, 1987 and identified by Ser. No. 87/00164-0. The certified copy of that Swedish application can be found in the file of the foregoing original U.S. application Ser. No. 142,735, now abandoned.

SUMMARY OF THE INVENTION

This invention relates generally to a method for detecting overheating in bearings, and deals more particularly with an auto-correlation technique such that the detection can be accomplished while the vehicle in which the bearings are provided moves past detector means provided in its path.

The invention has been developed particularly with reference to detecting overheating of bearings in railway cars while the cars are moving along a railroad track and the invention will be described with reference to this railway art. It should be noted, however, that the invention is not restricted to this field of use.

Overheating of bearings may cause great damage and problems with respect to down time of railway equipment, and it is therefore of great importance to minimize the risk of break downs by detecting overheated bearings while the vehicles are operating. It is impractical to stop the vehicle in order to observe the temperature in and adjacent to the bearings by manual testing. Such observations should be made while the vehicle is moving. Systems for detecting overheated bearings have been in use in the railway field, but such systems generally require infra-red detectors mounted adjacent to the track to observe bearing temperatures and to transmit signals representative of such temperatures to a computer located remotely from the detection sight.

In order to provide more accurate readings of such temperature measurements it is generally necessary to provide a further interpretation of what type of bearing is being checked, and of the temperature of that particular bearing. By correlating all registered temperatures it is possible to get an interpretation of the relative temperature of the different bearings and to compare such temperatures to some threshold value so as to provide an alarm signal in response to an abnormally high temperature in a specific bearing. In such prior art systems it is necessary to store temperatures for each specific bearing and bearing type so that they can be so compared to these threshold values.

One problem with a system of this general type is that different types of bearings give different temperature values. For example roller bearings and journal bearings and needle bearings all require different comparison values. It can be very time consuming even with the aid of a computer to analyze the values obtained and to reliably predict when an alarm should be generated as a result of too high a temperature in a particular bearing. False alarms are common with such systems.

The object of this invention is to provide a method for detecting overheating of bearings such that safety is assured by generating alarm signals in a reliable manner in spite of the requirement for analyzing bearings of different types. The temperature of each wheel bearing is compared to the temperatures of the bearings of only adjacent wheels on the same or on adjacent axles. The compared temperature values are obtained by a particular logic, and the alarm limit is calculated from measured values for all adjacent wheels and is chosen from the values or wheels closest to each other. An alarm limit is defined that is unique for each wheel axle bearing type. Advantage is taken of the fact that in a particular railway wagon only one type of bearing will be provided for all of the various wheels and axles. It will always be the case that at least two and sometimes more than two axle sets passing a particular site on the railway track will have the same general bearing type.

DETAILED DESCRIPTION

Figure 1:
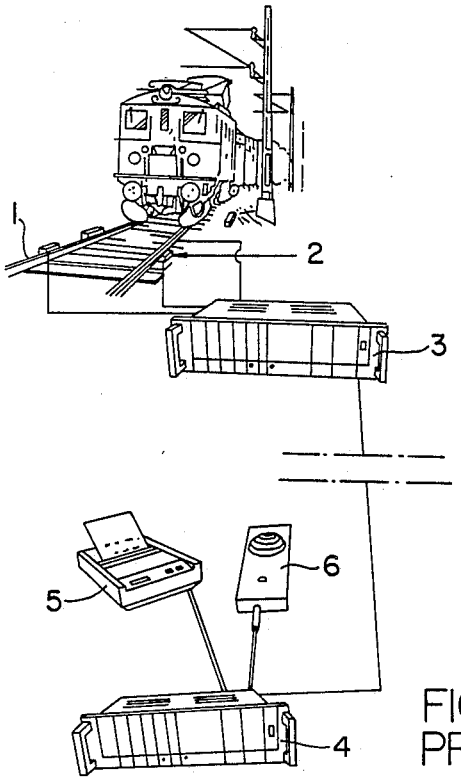
FIG. 1 PRIOR ART
FIG. 1 shows a general prior art system for detecting temperatures of bearings in railway wagon sets.

FIG. 1 illustrates a known system that includes detectors 1 and 2 provided alongside a railroad track, which detectors have their outputs fed to a computer 3 that is programmed to process the observed values and to transmit information to a remote location as indicated generally at 4. At this remote location means is provided in the form of a printer 5 and an alarm device 6 to continually monitor the condition of the detectors 1 and 2 at the remote location alongside the railroad track.

Figure 2:
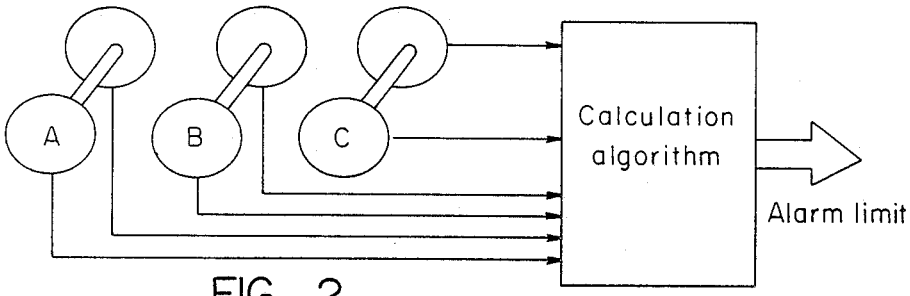
FIG. 2 illustrates in diagrammatic fashion the basic principle of the method according to the present invention.

As illustrated in FIG. 2 the measured temperatures of at least three successive main axles A, B and C (that is of six wheels are collected). A calculation algorithm provides a unique comparison for theses various input signals to generate an alarm signal in accordance with the present invention.

The method of the present invention comprises the following steps:

1. A mean value for the temperatures of all bearings on the left side and for all bearings on the right side of each railway wagon set is calculated.

2. A climate compensation correction is introduced and all temperature measuring values for bearings on the side of the wagon having the lowest temperature are increased as will be discussed in connection with FIG. 3.

3. A lowest or minimum measured value is defined for each axle, which lowest value is supposed to be the best value or the safety value for the algorithm to be described. This lowest value is stored or preprogrammed in the computer to identify whether it be on the left or right side of the vehicle and with respect to which axle this value is associated.

4. A reference value for each intermediate or the second of three axles being detected is calculated by an algorithm, which uses the lowest value of said at least three successive axle detection values. By corresponding algorithms the reference values are then calculated for all axles, except for the first and the last axle of the railway vehicle. These values for bearings of the first and the last or third axle can be calculated easily, since the bearings must be of the same type as that of the last axle but one, or the axle following the first axle, and this relationship assures that the first and last axles get the same reference values.

5. The reference value is multiplied by a constant value chosen by the operator, and switches are set to form the alarm limit of the axle for "high level alarm". Thereafter, the calculated alarm limit does not exceed the maximum allowed alarm limit nor is it lower than the minimum allowed alarm limit. The "high level alarm" limit can be restricted to a temperature interval, for instance 50°-90° C. The "low level alarm" limit is calculated as a percentage of the high level alarm limit. This percentage may be preset by switches similar to those for presetting the high level of alarm limit.

6. The measured temperature value for the left wheel and the right wheel respectively is compared with the alarm limit for the axle, and 7. If it be found that the measured temperature is higher than the high level alarm limit or is higher than the low level alarm limit alarm is given and the wagon in question is taken out of traffic to be repaired. This precaution will have been accomplished before any damage might occur.

Figure 3:
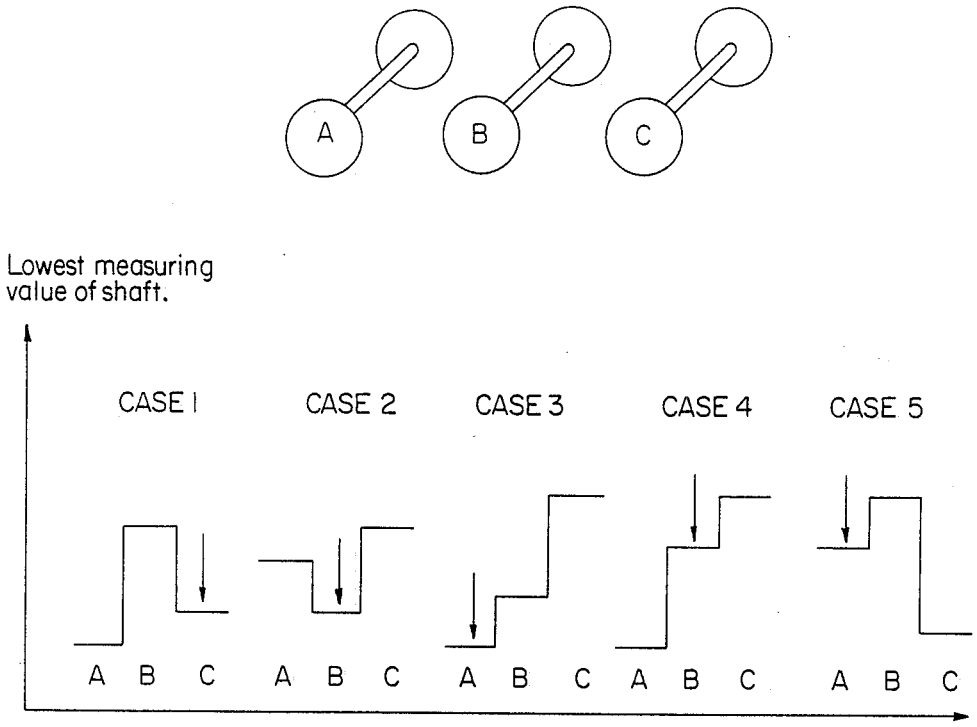
FIG. 3 illustrates graphically the various cases or conditions encountered by three railway wheel sets passing a particular point on a railroad track.

Turning next to a detailed description of the algorithm calculation for three successive axles A, B and C, reference is made to FIG. 3 of the drawings. Case I illustrated in FIG. 3 shows that the shaft B has the greatest or highest temperature value and maybe one which will trigger the alarm. As a reference value the value chosen (C) is that closest to the higher of the three because this is probably the value corresponding to the same type of bearing. Of course it is possible to compare A and C, and if their values are located close to each other they would represent the same type of bearing, but if A and C have nearly the same value it is of little importance which is chosen as a reference. The main principle is to choose the lowest value of adjacent values so as to make sure the reference value is not set too high, and so that there is no risk that an alarm be given too late. By means of the algorithm it is possible to eliminate the problem faced by any system that seeks to detect overheating in bearings of different types. The various cases illustrated in FIG. 3 will be described in detail.

Case I illustrates axle B having the highest temperature value. In this case it is obvious that the temperatures of the axles B and C are more closely related to each other than A and B for example. The indicated temperature for axle A is relatively distant from that of axle B. Since B and C appear to be more closely related in temperature it is likely that they are readings from bearing of the same general type. Therefore the selection of axle C as a reference value is the most logical one.

Case II shows the axle B to have the lowest value and the two values being closest to one another are A and B. Therefore axle B is chosen as the reference value.

Case III shows the values for the axles A and B as being relatively closely related to one another and therefore the reference value chosen is that of axle A.

Case IV shows that B and C are most closely related to another in temperature and the lowest value chosen for reference will be that of axle B.

Case V shows A and B to be the most closely related and since axle A is a lower value it will chosen as the reference value.

Figure 4:
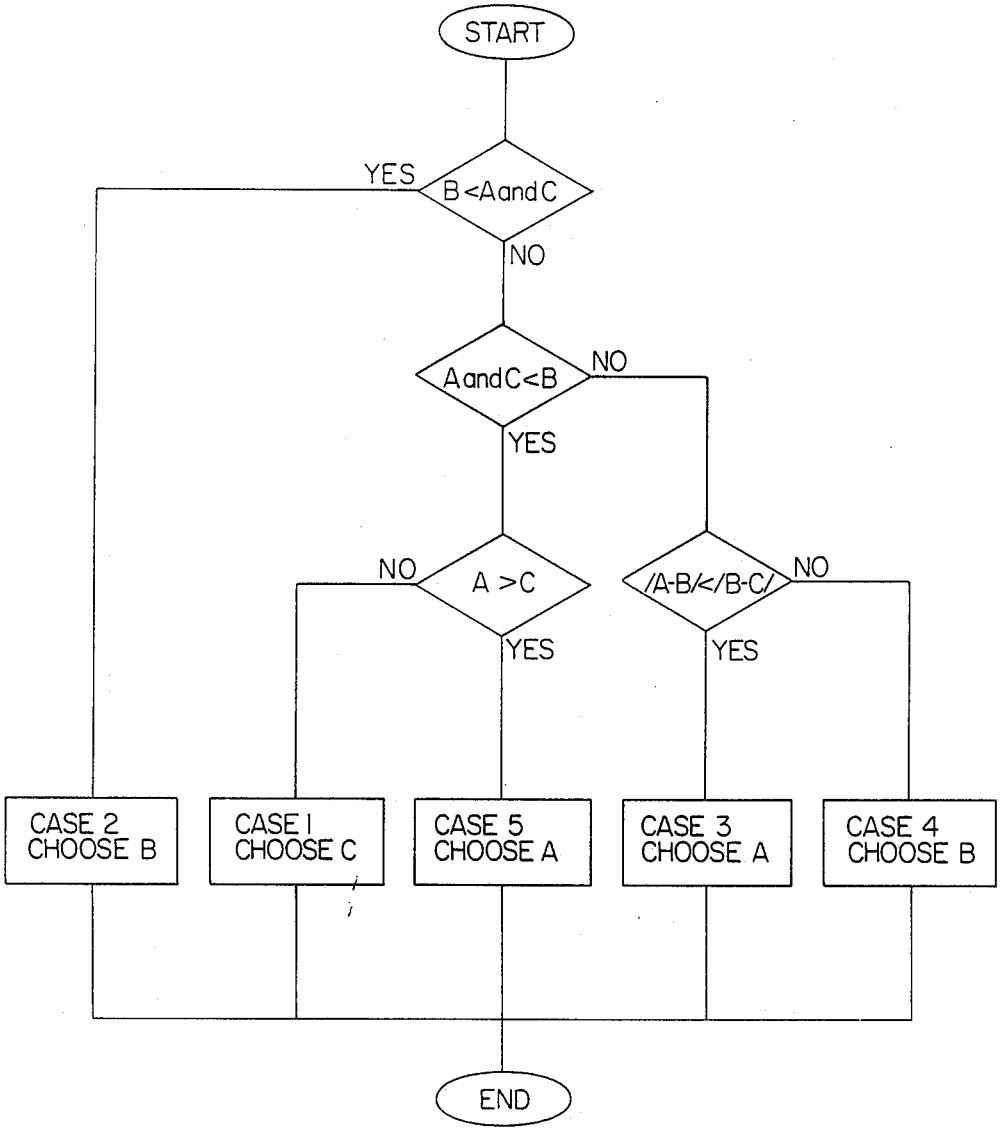
FIG. 4 shows in block diagram form the logic for comparison or calculation in accordance with the present invention.

FIG. 4 shows in block diagram form a logic or algorithm that will achieve the results described briefly in the preceding paragraph. If B is less than both A and C, B will be chosen as reference value. On the other hand, should that not be the case and if A and C are both less than B a further determination is required so that only if A is greater than C will A be chosen as a reference. If A is less than C, C must be chosen as the reference value. If A and C are greater than B a further calculation must be made to determine whether A minus B is less than B minus C. If so the value of axle A is chosen if A minus B is greater than B minus C axle B is chosen as the reference value. Thus, the algorithm is made up of several repeated comparative steps between three or more axles. While the foregoing description only refers to five comparative samples between the three successive axles it is to be understood that corresponding comparative samples can be taken between more than three axles and that even safer values can be obtained by such multi-comparative sampling.

I claim:

1. A method for detecting over heated bearings in a vehicle sequentially passing a fixed detector capable of providing successive signals related to the temperature of the bearings associated with each of successively moving axles associated with such bearings, said method comprising the following steps:

comparing at least three such signals A, B and C, which signals correspond to the temperatures of three axle bearings to determine if a condition I exists, said condition I being if B is less and A, and if B is less than C, and choosing B if condition I exists, subjecting said signals A, B and C to a further comparison step if said condition I is not present to determine if a condition II exits, said condition II being if A is less than B, and if C is less than, and if A is greater than C choosing A if said condition II exits, choosing C if C is greater than A establishing a condition III, subjecting said signals A, B and C to a still further comparison if said conditions I, II and III are not present to determine if a condition IV exits, said condition IV being if A minus B is less than B minus C and choosing A if condition IV exits, and comparing the signal so chosen A, B or C to the signals not chosen.

2. The method of claim 1 further characterized by providing an alarm signal when one of said signals A, B or C exceeds said chosen reference signal by a predetermined value representing a temperature that should not be exceeded.

3. The method of claim 1 further characterized by the additional step of providing a choose B output if conditions I, II and III are not present, and if B minus C is less than A minus B thereby establishing a condition V.

* * * * *